US009765482B2

(12) United States Patent
Cutts

(10) Patent No.: US 9,765,482 B2
(45) Date of Patent: Sep. 19, 2017

(54) MANUFACTURE OF PAPER AND PAPERBOARD CONTAINING WOOD FREE PULP

(71) Applicant: BASF SE, Ludwigshafen (DE)

(72) Inventor: Paul Kenneth Cutts, Leeds (GB)

(73) Assignee: BASF SE, Ludwigshafen (DE)

( * ) Notice: Subject to any disclaimer, the term of this patent is extended or adjusted under 35 U.S.C. 154(b) by 0 days.

(21) Appl. No.: 15/026,872

(22) PCT Filed: Oct. 3, 2014

(86) PCT No.: PCT/IB2014/065034
§ 371 (c)(1),
(2) Date: Apr. 1, 2016

(87) PCT Pub. No.: WO2015/052625
PCT Pub. Date: Apr. 16, 2015

(65) Prior Publication Data

US 2016/0237621 A1 Aug. 18, 2016

(30) Foreign Application Priority Data

Oct. 7, 2013 (EP) ..... 13187492

(51) Int. Cl.

| | |
|---|---|
| ***D21H 21/10*** | (2006.01) |
| ***D21H 17/67*** | (2006.01) |
| ***D21H 17/37*** | (2006.01) |
| ***D21H 11/08*** | (2006.01) |
| ***D21H 11/12*** | (2006.01) |
| ***D21H 17/44*** | (2006.01) |
| ***D21H 17/68*** | (2006.01) |
| ***D21H 11/10*** | (2006.01) |

(52) U.S. Cl.
CPC ..... *D21H 17/675* (2013.01); *D21H 11/08* (2013.01); *D21H 11/10* (2013.01); *D21H 11/12* (2013.01); *D21H 17/375* (2013.01); *D21H 17/44* (2013.01); *D21H 17/67* (2013.01); *D21H 17/68* (2013.01); *D21H 21/10* (2013.01)

(58) Field of Classification Search
None
See application file for complete search history.

(56) References Cited

U.S. PATENT DOCUMENTS

| | | | | |
|---|---|---|---|---|
| 4,347,101 | A | 8/1982 | Villavicencio | |
| 5,505,819 | A | 4/1996 | De Witt et al. | |
| 6,436,238 | B1 | 8/2002 | Pitkanen et al. | |
| 8,168,040 | B2 | 5/2012 | Reinicke | |
| 8,454,796 | B2 | 6/2013 | Reinicke | |
| 2002/0088565 | A1 | 7/2002 | Harvey et al. | |
| 2003/0079848 | A1* | 5/2003 | Ahlgren | D21H 21/10 162/181.8 |
| 2005/0279474 | A1* | 12/2005 | Sanne | D21H 17/68 162/158 |
| 2006/0231227 | A1* | 10/2006 | Williams | D21H 21/54 162/158 |
| 2007/0151688 | A1 | 7/2007 | Solhage et al. | |
| 2008/0223536 | A1* | 9/2008 | Van Der Horst | D21H 17/26 162/177 |
| 2012/0227920 | A1* | 9/2012 | Juppo | D21H 21/10 162/164.6 |
| 2014/0124156 | A1 | 5/2014 | Lepomaki et al. | |

FOREIGN PATENT DOCUMENTS

| | | | |
|---|---|---|---|
| CN | 101680189 | A | 3/2010 |
| CN | 101952512 | A | 1/2011 |
| CN | 102268837 | A | 12/2011 |
| CN | 102493258 | A | 6/2012 |
| CN | 102817282 | A | 12/2012 |
| CN | 103276626 | A | 9/2013 |
| CN | 103981756 | A | 8/2014 |
| DE | 102009010696 | | 9/2010 |
| EP | 0 102 760 | A2 | 3/1984 |
| EP | 0 126 528 | A2 | 11/1984 |
| EP | 0 150 933 | A2 | 8/1985 |
| JP | 2005-240227 | A | 9/2005 |
| JP | 2005-240249 | A | 9/2005 |
| JP | 2005-336678 | A | 12/2005 |
| JP | 2008-261078 | A | 10/2008 |

(Continued)

OTHER PUBLICATIONS

International Search Report and Written Opinion issued Jan. 26, 2015 in PCT/IB2014/065034 filed on Oct. 3, 2014 (reference previously filed, submitting additional pages).
International Preliminary Report on Patentability and Written Opinion issued Apr. 21, 2016 in Corresponding PCT/IB2014/065034 filed Oct. 3, 2014.
International Search Report issued Jan. 26, 2015 in PCT/IB2014/065034 filed on Oct. 3, 2014.
Written Opinion issued Jan. 26, 2015 in PCT/IB2014/065034 filed on Oct. 3, 2014.

(Continued)

*Primary Examiner* — Mark Halpern
(74) *Attorney, Agent, or Firm* — Oblon, McClelland, Maier & Neustadt, L.L.P.

(57) ABSTRACT

The present invention relates to a process of manufacturing paper or paperboard which comprises providing (a) a mechanical pulp and (b) a wood free pulp, combining (a) the mechanical pulp and (b) the wood free pulp to form a mixed pulp comprising no more than 20% by total dry weight of fiber of the mechanical pulp, flowing the mixed pulp as a medium consistency stock and combining the medium consistency stock with dilution water to form a low consistency stock, draining the low consistency stock through a wire or mesh to form a sheet of paper which is dried, in which additional filler and a cationic polymer are added to the mechanical pulp.

11 Claims, No Drawings

(56) References Cited

FOREIGN PATENT DOCUMENTS

| | | | |
|---|---|---|---|
| KR | 2009-0117799 | | 11/2009 |
| WO | 93/22499 | A1 | 11/1993 |
| WO | WO 2012/148405 | | 11/2012 |
| WO | 2012/163787 | A1 | 12/2012 |
| WO | 2012/175788 | A1 | 12/2012 |
| WO | WO 2012/163787 | A1 | 12/2012 |
| WO | WO 2012/175528 | | 12/2012 |
| WO | WO 2013/127731 | | 9/2013 |

OTHER PUBLICATIONS

Extended European Search Report dated May 29, 2017, in European Patent Application No. 14852860.7 ( 6 pages).

Office Action issued May 31, 2017, in Korean patent application No. 10-2016-7008822 (w/English translation).

* cited by examiner

MANUFACTURE OF PAPER AND PAPERBOARD CONTAINING WOOD FREE PULP

This application is a 371 of PCT/IB2014/065034 filed on 3 Oct. 2014

The present invention concerns a process of manufacturing paper or paperboard which comprises a mixture of wood free pulp and mechanical pulp. The process involves a novel system of incorporating additional filler which avoids the risk of poor sheet formation.

Wood free paper is the term often given to paper which has been made predominantly from wood free pulp. In general Wood free pulp means a chemical pulp rather than a mechanical pulp. Such wood free or chemical pulp is normally made from pulpwood, but would not be considered wood as most of the lignin is removed from the cellulosic fibers during chemical processing. By contrast mechanical pulp is primarily physically treated and retains most of the wood components and as such may still be described as wood.

Mechanical Pulping produces a high yield pulp of 85-95% compared to only 45% from Chemical Pulping. The process uses very little or no chemicals but is extremely energy intensive. The breaking down of the wood into fibers can be done by either grinding wood logs against a revolving abrasive surface (usually stone) which gives a Groundwood pulp or by passing wood chips between one rotating (rotor) and one stationary (stator) metal disc. This process is called refining and produces a pulp often referred to as a refiner mechanical pulp. Heat can also be used in mechanical pulping to produce Thermo-mechanical pulp (TMP). Limited chemical treatment of thermo-mechanical pulp (TMP) can be used to produce chemithermomechanical pulp (CTMP). If the chemithermomechanical pulp is then bleached the resulting pulp is referred to as bleached chemithermomechanical pulp (BCTMP). This pulp mostly retains the physical properties of thermomechanical pulp although the yield is reduced. Nevertheless BCTMP has the advantage that it is cleaner and brighter than thermomechanical pulp (TMP).

Wood Free or Chemical Pulping may be described as a process of pulping using chemicals and heat rather than mechanical action. Wood free pulp can be produced by the Kraft process or the sulphite process. The Kraft process employs sodium hydroxide and sodium sulphide at 170-176° C. The sulphite process uses sulphites or bisulphites at 130-160° C. Cooking under these conditions in pressurised digesters removes lignins and hemicelluloses from the fibers by making them soluble.

Wood free paper has the advantage over paper made from high levels of mechanical pulp in that it is not as prone to yellowing. Consequently, it is usual to make fine paper and other high quality paper from predominantly wood free pulp. Nevertheless, it is common to incorporate up to 10% by weight of mechanical pulp, based on the total cellulosic fiber, into wood free paper to improve certain physical characteristics of the formed paper such as improving stiffness or the bulk of the sheet. In order to provide up to 10% by weight of mechanical pulp in the final paper it is usually necessary to incorporate up to 20% on a dry weight basis, for instance 15-20%, of mechanical pulp in the papermaking stock.

Manufacturing paper containing a predominance of wood free pulp typically employs additives such as filler and retention aids in order to facilitate sheet formation on the moving wire/mesh of a machine.

Fillers are inorganic particles which are added to the paper to increase opacity, smoothness and printability but also reduce the cost of the paper produced. Examples of fillers include kaolin, titanium dioxide, precipitated calcium carbonate (PCC) and ground calcium carbonate (GCC).

Retention aids are (usually) polymeric additives which flocculate the small filler particles onto the papermaking fibers, so that the filler material is retained in the paper sheet.

A retention system is where one or more retention aids are used to create the overall retention effect required.

It is usual to add the filler to the combined medium consistency stock stream or low consistency stream.

It is well known to manufacture paper by a process that comprises flocculating a low consistency stock, often termed cellulosic thin stock, by the addition of polymeric retention aid and then draining the flocculated suspension through a wire or mesh, often referred to as a machine wire, and then forming a wet sheet, which is then dried.

WO 93 22499 describes a process of making a wood free white paper products employing bleached cellulosic pulp fibers consisting of recycled fibers. Other disclosures of providing wood free paper include JP 2005 240227, JP 2005 240249, JP 2005 336678, CN 102493258, and WO 2012 163787.

Producers of wood free paper, such as fine paper producers, are generally keen to increase the filler content of the paper product in order to reduce costs. However, retaining this extra filler can be difficult, expensive and can cause problems with poor sheet formation. Furthermore, increasing the filler content of wood free paper has a tendency to reduce the sheet bulk and reduce the sheet stiffness. In order to counteract this disadvantage many producers of wood free paper incorporate up to 10% by weight mechanical fiber, especially bleached chemical thermo mechanical pulp (BCTMP), into the paper sheet. Nevertheless incorporating this mechanical fiber into the wood free pulp does not improve the filler retention and indeed may even be detrimental in some cases to filler retention.

It would be desirable provide a process which provides increased filler retention in paper or board manufacture when employing predominantly wood free pulp, containing up to 10% by weight mechanical pulp, into the paper sheet.

In accordance with the present invention we provide a process of manufacturing paper or paperboard which comprises

- providing (a) a mechanical pulp and (b) a wood free pulp
- combining (a) the mechanical pulp and (b) the wood free pulp to form a mixed pulp comprising no more than 20% by total dry weight of fiber of the mechanical pulp,
- flowing the mixed pulp as a medium consistency stock and combining the medium consistency stock with dilution water to form a low consistency stock draining the low consistency stock through a wire or mesh to form a sheet of paper which is dried, in which filler and a cationic polymer are added to the mechanical pulp.

By combining the mechanical pulp and the wood free pulp it is meant that the two pulps are mixed together. Suitably this can be achieved by agitation, for example by stirring at a rate of between 100 and 600 rpm, or by other means of agitation. In general in a papermaking machine the two pulps may be combined by flowing a stream of the mechanical pulp and flowing a stream of the wood free pulp such that the two streams join together, for instance in a blend chest, to form a mixed pulp. Normally the turbulence which naturally occurs in a paper machine will be sufficient to allow the two pulps to distribute throughout each other in forming the mixed pulp. Typically in a papermaking machine the mixed pulp can be flowed as a medium consistency stock, which may be regarded as a medium consistency stream. Such a medium consistency stock or stream can be diluted by the addition of water to form a low consistency stock which when flowed in a papermaking system may be regarded as a low consistency stream. The wire or mesh through which the low consistency stock or stream is passed may be a suitable wire or mesh generally used in the paper industry for draining papermaking stocks to form a sheet. Usually in a papermaking machine the wire or mesh is a moving wire or mesh onto which the low consistency stock or stream flows and drains to form a sheet of paper. The sheet of paper is generally pressed then dried in the drying section of a papermaking machine.

Dry papermaking solids are determined by filtering 100 mls of the thin stock through a pre-dried and weighed cellulosic filter paper, drying to constant weight at 105° C. and calculating the dry solids as %. The pre-dried (at 105° C.) and pre-weighed filter paper is placed into a Hartley funnel, Buchner funnel or similar which is placed on a vacuum flask. 100 ml of the stock is measured in a measuring cylinder or 100 g is weighed into a beaker, and poured onto the filter paper. A vacuum is applied to the flask to remove the free water and then the filter paper is removed and dried at 105° C. for two hours and re-weighed.

According to the invention, additional filler is added to the mechanical pulp and fixed using a cationic polymer, before the mechanical pulp is mixed with other pulps to form the medium consistency stock Desirably, the amount of filler which is incorporated into the mechanical pulp, for instance as a mechanical pulp stream, is at least 1% by dry weight of mechanical pulp. Typically the amount of filler added to this mechanical pulp, for instance as a mechanical pulp stream, should be at least 2% and often at least 5% by dry weight of mechanical pulp. Suitably the amount of filler added to the mechanical pulp, for instance as a mechanical pulp stream, may be significantly higher, for instance up to 20 or 25% by dry weight of the mechanical pulp. Usually though the amount of added filler would tend to be below 20%, for instance up to 15% or 16% by dry weight of the mechanical pulp.

The amount of filler by dry weight of stock can be determined by the following method. The stock is filtered and dried at 105° C. and then weighed to obtain the dry weight of stock by the method described above. The dry stock is then placed in a furnace at 500° C. for two hours and the ash content is determined as a weight. Higher or lower temperatures can be used for this purpose. Filler content can be calculated from the known ash content of the filler at the chosen temperature. In many paper mills the measured ash content figure is used rather than the true filler content, both for the papermaking stock and also the finished paper sheet.

Typically the process may also include the addition of filler to the process consistent with the conventional addition points of filler in paper and board making processes. Therefore filler may also be added to any of the mixed pulp, medium consistency stock or stream and/or the low consistency stock or stream, which is normal papermaking practice for addition of filler. Since the amount of filler added at this stage would tend to be higher than the filler added to the mechanical pulp or stream, this subsequent addition of filler may be regarded as the main filler addition.

Suitable fillers for addition to the mechanical pulp or mechanical pulp stream or for the main filler addition can be any conventional fillers traditionally used in paper and paperboard manufacturing processes. Examples of desirable fillers are selected from the group consisting of precipitated calcium carbonate, ground calcium carbonate, kaolin, and titanium dioxide.

In the process of the present invention a cationic polymer is added to the mechanical pulp, for instance as a mechanical pulp stream. The amount of cationic polymer in general should be at least 100 g polymer per tonne of dry mechanical pulp. For a polymer which is supplied as a solid grade, this is calculated as grams of as received polymer per tonne dry papermaking solids. For polymers supplied as solutions, emulsion or liquid dispersions, this is calculated as grams of active polymer per tonne of papermaking solids. More beneficial results may often be seen with higher doses of cationic polymer, for instance at least 200 g polymer per tonne of dry mechanical pulp, preferably at least 500 g per tonne. The amount of cationic polymer may often be much higher, for instance up to 2.5 or 3.0 kg per tonne of dry mechanical pulp. Typically the amount of added cationic polymer should be up to 2.0 kg per tonne, for instance up to 1.5 or 1.6 kg per tonne and in some cases up to 1.0, 1.1 or 1.2 kg per tonne.

Any conventional cationic polymer, especially those used in the paper industry, may be used as the cationic polymer added to the mechanical pulp or mechanical pulp stream in accordance with the present invention. The polymers may be natural or synthetic. Suitable natural polymers include cationic starch. Suitable synthetic cationic polymers include polymers of water-soluble ethylenically unsaturated monomer or blend of water-soluble ethylenically unsaturated monomers in which at least one of the monomers is cationic. Where the polymers are formed from more than one monomer the other monomers may be either cationic or non-ionic or a mixture.

The cationic monomers include dialkylamino alkyl (meth) acrylates, dialkylamino alkyl (meth) acrylamides, including acid addition and quaternary ammonium salts thereof, diallyl dimethyl ammonium chloride. Preferred cationic monomers include the methyl chloride quaternary ammonium salts of dimethylamino ethyl acrylate and dimethyl aminoethyl methacrylate. Suitable non-ionic monomers include unsaturated nonionic monomers, for instance acrylamide, methacrylamide, hydroxyethyl acrylate, N-vinylpyrrolidone. A particularly preferred polymer includes the copolymer of acrylamide with the methyl chloride quaternary ammonium salts of dimethylamino ethyl acrylate.

This cationic polymer preferably contains at least 5 mol % cationic monomer units and up to 80 mol % cationic monomer units, more preferably between 5 and 40 mol % cationic monomer units, especially between 5 and 20 mol %. A particularly preferred first polymeric retention aids are also cationic polyacrylamides comprising acrylamide and at least one water-soluble cationic ethylenically unsaturated monomer, preferably quaternary ammonium salts of dialkyl amino alkyl (meth)-acrylates or N-substituted-acrylamides, especially the methyl chloride quaternary ammonium salts of dimethylamino ethyl acrylate.

Generally these cationic polymers will tend to have a high molar mass, usually in excess of 500,000 Da and often at least 1,000,000 Da. Suitably polymers will exhibit an intrinsic viscosity of at least 3 dl/g and preferably at least 4 dl/g. In some cases the polymers may exhibit intrinsic viscosities of at least 5 and often at least 6 dl/g. In many cases it may be at least 7 or even at least 8.5 or 9 dl/g, and often at least 10 dl/g and more preferably at least 12 dl/g and particularly at least 14 or 15 dl/g. There is no maximum molecular weight necessary for this cationic polymer of component (b)

and so there is no particular upper value of intrinsic viscosity. In fact the intrinsic viscosity may even be as high as 30 dl/g or higher. Generally though the first polymeric retention aid often has an intrinsic viscosity of up to 25 dl/g, for instance up to 20 dl/g.

Intrinsic viscosity of polymers may be determined by preparing an aqueous solution of the polymer (0.5-1% w/w) based on the active content of the polymer. 2 g of this 0.5-1% polymer solution is diluted to 100 ml in a volumetric flask with 50 ml of 2M sodium chloride solution that is buffered to pH 7.0 (using 1.56 g sodium dihydrogen phosphate and 32.26 g disodium hydrogen phosphate per liter of deionised water) and the whole is diluted to the 100 ml mark with deionised water. The intrinsic viscosity of the polymers is measured using a Number 1 suspended level viscometer at 25° C. in 1M buffered salt solution. Intrinsic viscosity values stated are determined according to this method unless otherwise stated.

Desirably the cationic polymer may be provided as reverse-phase emulsions prepared by reverse phase emulsion polymerisation, optionally followed by dehydration under reduced pressure and temperature and often referred to as azeotropic dehydration to form a dispersion of polymer particles in oil. Alternatively, the polymer may be provided in the form of beads and prepared by reverse phase suspension polymerisation, or prepared as a powder by aqueous solution polymerisation followed by comminution, drying and then grinding. The polymers may be produced as beads by suspension polymerisation or as a water-in-oil emulsion or dispersion by water-in-oil emulsion polymerisation, for example according to a process defined by EP-A-150933, EP-A-102760 or EP-A-126528. The active polymer content in an emulsion or dispersion product may be determined by dispersing the product into acetone to leave free polymer. The polymer is then separated by filtering through a pre-dried (at 105° C.) and pre-weighed filter paper. This is then air dried and then oven dried (at temperature 105° C.) to a minimum weight from which it is possible to calculate the active polymer content in the emulsion or dispersion. The amount of water in the polymer beads or powder is generally less than 10% % and is normality ignored and the product dose calculated on as received product.

Generally any of the cationic polymers added to the mechanical pulp stream in accordance with the present invention may be made into an aqueous solution before being dosed into the mechanical pulp stream. This may for instance be achieved in a suitable polymer solution make up device. Such equipment is described in the prior art and for instance commercialised by BASF under the trademark Jet Wet™.

The mechanical pulp used in accordance with the present invention preferably is a bleached chemical thermo mechanical pulp (BCTMP).

The mixed pulp can be employed a medium consistency stock and can be flowed as a medium consistency stream before being diluted. This medium consistency stock or medium consistency stock stream may be referred to as a thick stock and will typically have a concentration of at least 2% by weight of cellulosic fibers based on total weight of the medium consistency stock or stream. Often the medium consistency stock or medium consistency stream is at least 3% and in some cases even as high as 4% or 5% in concentration up to 8% by weight. If the mixed pulp is more concentrated than required for use as a medium consistency stock it may be desirable to adjust the concentration as desired by dilution with water.

Medium consistency stock contains 2 to 8% papermaking solids in water, low consistency is <2% papermaking solids in water (source: Tappi). In general low consistency stock (i.e. <2%) is found in the wet end of the paper machine and the fiber recovery. This makes up about 15-20% of most mill applications. Medium consistency stock is found in about 70% of pulp and paper mill applications. High concentrations are defined as 8 to-15%, which comprise applications immediately after the digester. These concentrations can be determined by the weight in grams of oven dried fiber in 100 g of pulp water mixture [TAPPI 1993]

The dilution water may be water recycled from the process, for instance during the draining of the low consistency stock or low consistency stream through a wire or mesh, which may be moving, often referred to as whitewater or backwater. In some closed papermaking systems a high proportion of the dilution water is water recycled from the process. Nevertheless it is usual for at least some of the dilution water to be fresh water.

The low consistency stock or low consistency stream that has been formed by combining dilution water with the medium consistency stock or medium consistency stream is suitably flowed to a wire or mesh, which may be moving, on which a cellulosic sheet is formed while water from the low consistency stock or stream drains through the wire or mesh.

Between the dilution point and the wire or mesh it is usual for the low consistency stock, for instance as a low consistency stream, to pass through several stages, for instance pumping, mixing and cleaning stages. Normally the low consistency stock or low consistency stream will pass through at least one fan pump, frequently two or three fan pumps before passing through at least one pressure screen, also referred to as a centriscreen.

Suitably the process of the present invention further employs a retention system. Desirably this retention system should employ at least one retention aid. Normally the retention system is added to either the medium consistency stock or stream and/or low consistency stock or stream. Preferably the one or more retention aids of the retention system is/are added to the low consistency stock or stream.

Desirably the one or more retention aids of the retention system are synthetic polymers and/or natural polymers. Typically at least one retention aid of the retention system should be a cationic polymer. Preferably the cationic polymer may be any of the cationic polymers described in regard to suitable cationic polymers added to the mechanical pulp or mechanical pulp stream. Suitably the cationic polymer added as a retention aid in the retention system may be added as an aqueous solution. Typical doses of cationic polymer as a retention aid may be at least 50 g polymer per tonne of dry weight of the cellulosic suspension either as low consistency stock or stream or medium consistency stock or stream. Usually this will be at least 100 g per tonne and typically at least 200 and sometimes at least 300 g per tonne. The dose of cationic polymer may be as much as 1.5 kg per tonne but is usually no more than 1 kg per tonne, for instance up to 800 g per tonne or up to 600 g per tonne. For a polymer which is supplied as a solid grade, this is calculated as grams of as received polymer per tonne dry papermaking solids. For polymers supplied as solutions, emulsion or liquid dispersions, this is calculated as grams of active polymer per tonne of papermaking solids. This is defined in the description above.

In many cases it may be desirable to include at least a second retention aid in the retention system. Desirably such a second retention aid may be an anionic retention additive such as an anionic polymer or microparticle.

The following examples illustrate the invention.

EXAMPLES

A synthetic fine paper stock was prepared by combining a wood free pulp (90% by weight of total dry stock) and a bleached chemical thermo mechanical pulp (BCTMP) (10% by weight of total dry stock). The synthetic fine paper stock had a filler content of 20% by total dry weight of stock. Reference to filler means precipitated calcium carbonate (PCC).

The PCC was Omya Syncarb F0474. This precipitated calcium carbonate product has an average particle size diameter of 1.83 μm. In the lab tests the PCC is added at 20% solids. This was diluted in tap water to 20% solids before addition as required.

Wood free pulp 50/50 Hardwood pine: Softwood birch blend beaten to a Schopper Riegler Freeness of 30°.

BCTMP Pulp Supplied from Metso Paper

The wood free pulp and the BCTMP pulp were prepared at 4% consistency and mixed together for 1 minute, stirring at 200 rpm Reference to extra filler means additional PCC added to either the BCTMP or synthetic fine paper stock.

Cationic Polymer added is Percol PBR20 which is a solid grade cationic polyacrylamide exhibiting an intrinsic viscosity of 10.9 dl/g supplied by BASF. Intrinsic viscosity is determined by the method described above in the description. The Cationic Polymer is dissolved in tap water as a 0.8% by weight solution and further diluted with tap water to 0.1% before addition in the following tests.

200 ml of water is placed into a 250 ml wide neck bottle. A stirrer is placed into the bottle. The speed of the stirrer should be between 600 and 1000 rev/min. The required amount of dry polymer to give the required concentration (typically 0.2-0.8%) is weighed into a paper weighing boat. The polymer is then slowly sprinkled from the paper boat into the vortex created by stirring such that formation of lumps is avoided (approx. 30 sec). Then the solution is stirred for 30-60 minutes after which time the polymer is ready to use.

Cationic polymer was dosed into the stock using a plastic pipette. When added to thick stock mixed with a stirrer at 200 rpm for 1 minute. When added to thinstock mixed at 500 rpm for 30 seconds.

For clarification since the synthetic fine paper stock contains 10% BCTMP 20% extra filler added to BCTMP is equivalent with the overall dose of 2% extra filler added to the synthetic fine paper stock and 1000 g/tonne Cationic Polymer added to BCTMP is equivalent to the overall dose of 100 g/tonne Cationic Polymer added to the synthetic fine paper stock.

All of the tests also employed 250 g/tonne Cationic Polymer added to the synthetic fine paper stock as a retention aid. This is calculated on the basis of the product as supplied (which is assumed to be substantially the same as active polymer content) on dry weight of stock, which is determined by the method described in the description.

Filler retention results were measured as first past ash retention (FPAR).

First Pass Ash Retention Measurement 500 mls of stock is placed into a Britt jar Retention tester fitted with a piece of standard Schopper Riegler wire. The stirrer is switched on at 500 rpm and after 10 seconds, polymer solution added as required. After 30 seconds mixing, the tap is opened and the first 25 mls of backwater discarded. The next 100 mls of backwater is collected. The tap is closed, the stirrer switched off and the remaining stock discarded and the apparatus washed clean for the next test The 100 mls sample is filtered over a pre-weighed and dried ashless filter paper and then dried at 105 degrees C. for 2 hrs. The filter paper is reweighed and the weight of solids in the backwater determined. The filter paper is the placed into a crucible and the crucible placed into a muffle furnace at 550 degrees C. for 3 hours.

The First pass ash Retention is calculated as

100% (wt ash in 100 mls stock−wt ash in 100 mls backwater)/wt. ash in 100 mls of stock

TABLE 1

| | BCTMP Addition | | Synthetic Fine Paper Stock Addition | | | Filler | Cationic Polymer Total in |
|---|---|---|---|---|---|---|---|
| No. | Filler (%) | Cationic Polymer (g/t) | Filler 20% + extra (%) | Cationic Polymer 250 (g/t) + extra (g/t) | FPAR (%) | Total in final stock (%) | final stock (%) |
| 1 | | | | | 47.8 | 20 | 250 |
| 2 | | | | Extra 100 | 47.8 | 20 | 350 |
| 3 | | | | Extra 200 | 49.2 | 20 | 450 |
| 4 | | | Extra 1 | | 44.6 | 21 | 250 |
| 5 | Extra 10 | | | | 51.0 | 21 | 250 |
| 6 | | Extra 1000 | Extra 1 | | 52.6 | 21 | 350 |
| 7 | Extra 10 | Extra 1000 | | | 55.4 | 21 | 350 |
| 8 | | Extra 2000 | Extra 1 | | 59.2 | 21 | 450 |
| 9 | Extra 10 | Extra 2000 | | | 63.5 | 21 | 450 |
| 10 | | | Extra 1 | Extra 100 | 52.2 | 21 | 350 |
| 11 | Extra 20 | | | | 46.3 | 22 | 250 |
| 12 | | Extra 1000 | Extra 2 | | 53.2 | 22 | 350 |
| 13 | Extra 20 | Extra 1000 | | | 53.4 | 22 | 350 |

TABLE 1-continued

| No. | BCTMP Addition Filler (%) | BCTMP Addition Cationic Polymer (g/t) | Synthetic Fine Paper Stock Addition Filler 20% + extra (%) | Synthetic Fine Paper Stock Addition Cationic Polymer 250 (g/t) + extra (g/t) | FPAR (%) | Filler Total in final stock (%) | Cationic Polymer Total in final stock (%) |
|---|---|---|---|---|---|---|---|
| 14 | | Extra 2000 | Extra 2 | | 47.5 | 22 | 450 |
| 15 | Extra 20 | Extra 2000 | | | 60.3 | 22 | 450 |
| 16 | | | Extra 2 | Extra 100 | 53.3 | 22 | 350 |
| 17 | Extra 20 | | | Extra 100 | 47.5 | 22 | 350 |
| 18 | | | Extra 2 | Extra 200 | 57.7 | 22 | 450 |
| 19 | Extra 20 | | | Extra 200 | 44.4 | 22 | 450 |

Experiments 1, 2, 3, 4 and 10 show the state of the art, adding extra filler and extra cationic polymer to the low consistency stock.

Experiments 5 and 6 show variations of addition point of filler and polymer, whereas example 7, the novel application of the invention adding both filler and cationic polymer to the mechanical pulp gives the best filler retention result.

At increased cationic polymer levels example 9 of the invention is better than example 8 adding extra cationic polymer in the low consistency stock.

At increased extra filler addition, example 15 of the invention gives a better filler retention result than the state of the art, experiments 16 and 18, and better than other variations of filler and cationic polymer addition.

The invention claimed is:

1. A process of manufacturing paper or paperboard, the process comprising:

adding a filler and a cationic polymer to a mechanical pulp;

combining the mechanical pulp combined with the filler and the cationic polymer and a wood free pulp to form a mixed pulp comprising no more than 20% by total dry weight of fiber of the mechanical pulp;

flowing the mixed pulp as a medium consistency stock and combining the medium consistency stock with dilution water to form a low consistency stock; and draining the low consistency stock through a wire or mesh and drying, thereby forming a sheet of paper.

2. The process according to claim 1, wherein an amount of the filler added to the mechanical pulp is from 1% to 20% by dry weight of the mechanical pulp.

3. The process according to claim 1, wherein the filler is also added to the mixed pulp, the medium consistency stock, the low consistency stock, or a combination thereof.

4. The process according to claim 1, wherein the filler is selected from the group consisting of precipitated calcium carbonate, ground calcium carbonate, kaolin and titanium dioxide.

5. The process according to claim 1, wherein an amount of the cationic polymer added to the mechanical pulp is at least 100 g polymer per ton of the dry mechanical pulp.

6. The process according to claim 1, wherein the cationic polymer is a polymer formed from (meth) acrylamide and a cationic monomer.

7. The process according to claim 1, wherein the cationic polymer exhibits an intrinsic viscosity of at least 4 dl/g.

8. The process according to claim 1, wherein the mechanical pulp is a bleached chemical thermo mechanical pulp (BCTMP).

9. The process according to claim 1, wherein the medium consistency stock, the low consistency stock, or both, is treated by adding a retention system.

10. The process according to claim 9, wherein the retention system comprises at least one retention additive comprising at least one cationic polymer.

11. The process according to claim 1, wherein an amount of the cationic polymer added to the mechanical pulp is at least 500 g polymer per ton of the dry mechanical pulp.

* * * * *